US005190279A

United States Patent [19]

Morris et al.

[11] Patent Number: 5,190,279

[45] Date of Patent: Mar. 2, 1993

[54] COPY OUTPUT STACKER FOR ENGINEERING SIZE COPIES

[75] Inventors: Daniel L. Morris; David A. Bartman, both of Webster; Albert E. Andrews, Rochester, all of N.Y.

[73] Assignee: Xerox Corporation, Stamford, Conn.

[21] Appl. No.: 888,582

[22] Filed: May 26, 1992

[51] Int. Cl.[5] ..... B65H 31/20

[52] U.S. Cl. ..... 271/223; 211/50

[58] Field of Search ..... 271/171, 207, 223, 224; 211/50

[56] References Cited

U.S. PATENT DOCUMENTS

| | | | |
|---|---|---|---|
| 4,819,930 | 4/1989 | Jackson | 271/223 X |
| 4,982,945 | 1/1991 | Marasco | 271/223 X |
| 5,040,777 | 8/1991 | Bell et al. | 271/3 |

*Primary Examiner*—Richard A. Schacher

[57] ABSTRACT

A low cost copy output stacker for engineering size copies includes a vertical catch tray molded into front doors of a copier/printer for accepting the lead edge of the copies and allowing the copies to bend over the top of the catch tray in a stacked position under gravity. A manually operated hinged stop is positioned in a down position blocking the path of copy sheets in order to keep them from reaching the bottom of the catch tray for stacking copy sheets size 11" to 24" and positioned in an up position for copy sheet sizes 24" to 48".

9 Claims, 5 Drawing Sheets

COPY OUTPUT STACKER FOR ENGINEERING SIZE COPIES

Cross-reference is hereby made to copending, concurrently filed, commonly assigned U.S. application Ser. No. 07/889,024, filed on May 26, 1992 in the name of Albert E. Andrews et al. and entitled ENGINEERING SIZE DOCUMENT STACKER, which Application is incorporated herein by reference.

This invention relates to a copier/printer machine that prints page image information onto copy sheets composed of a variety of media, including bond, vellum, film and tracing paper, or the like, measuring 18, 24, 36, 48×36", and more particularly, to an improved copy output stacking device for such a machine.

Heretofore, some output stackers on wide format copier/printers that are used to copy engineering drawings have included a stacking device that has a tray with a fixed depth. This type of stacking device makes stacking multiple length copy sheets impractical. Other copy sheet stacking devices (e.g. U.S. Pat. No. 5,040,777) require an operator to make multiple manual adjustments to adjust the size of the stacking device according to the size of original documents being fed into the machine. Also, a copy output device is needed that automatically gathers the copy sheet output copies as they exit the front of the copier and stacks them in the same order as the sequence of the originals. The copies within the stack would have to be able to range from "A" to "E" size and the stacking device itself must present little or no obstruction to media access to roll feeders and cutters, as well as, operator access to the control console and documents shelf of the machine. In order to make the operator more efficient and the copying process less labor intensive, a need exists for an improved copy output stacking device.

It is therefore an object of this invention to provide a copy sheet stacking device that stacks a wide variety of long copy sheets without operator involvement.

Therefore, the present invention provides a copy output device that comprises two curved plastic guides attached to the bottom of two doors that cover a machine's media supply. Further up the face of the doors are two hinged plates that, when placed in an open position, span a gap between the doors and the plastic guides and, when placed in a closed position, lie flush with the door surface. The length of the media to be run determines whether the hinged plates are open or closed.

Figure 1:
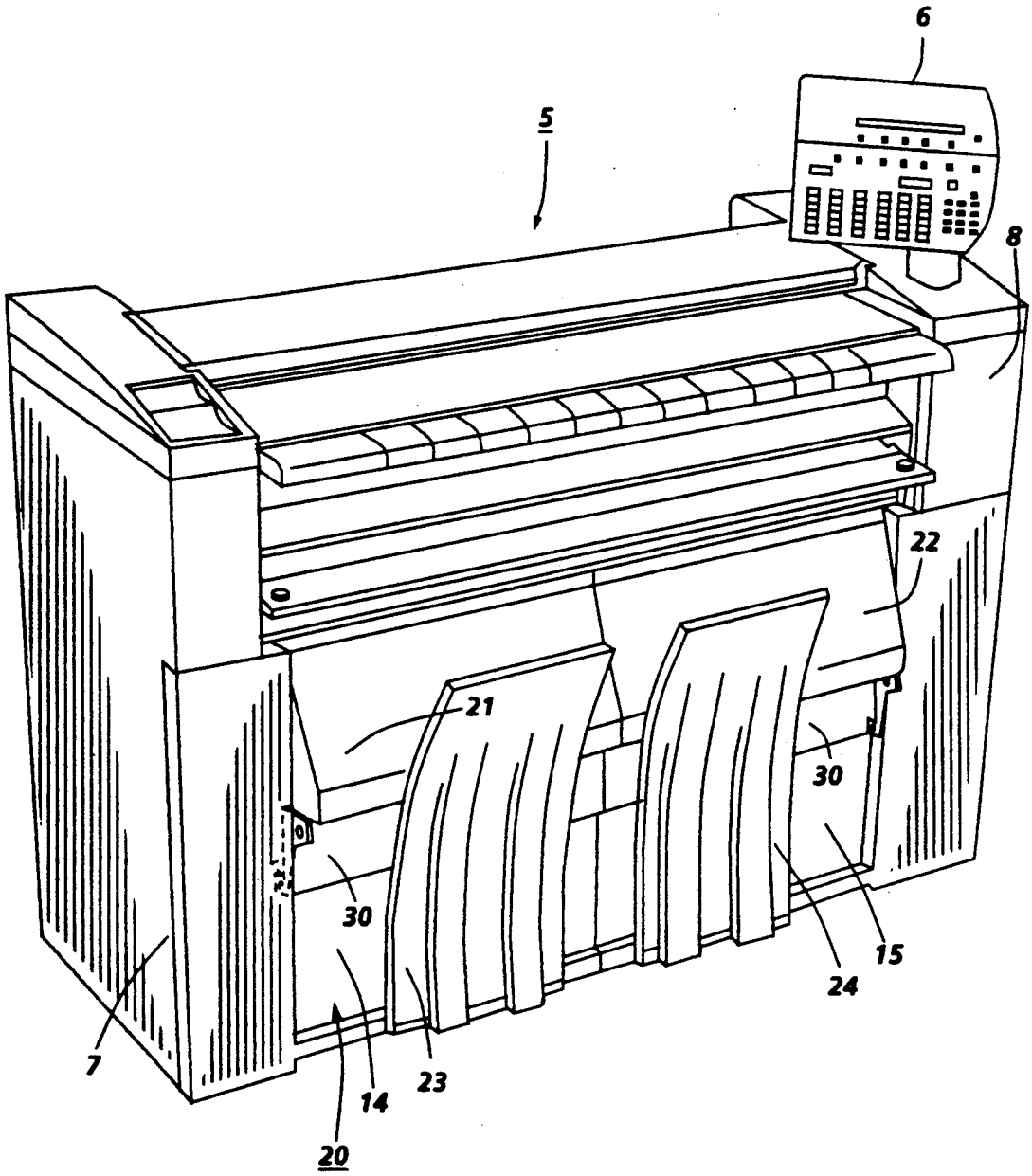
FIG. 1 is an isometric view of a copier/printer that employs the copy sheet output stacker of the present invention.

Referring now to the drawings in detail, and wherein like numbers indicate like elements, copy sheet output stacking device 20 is shown in FIG. 1 integrally molded into doors 14 and 15 of a copier/printer 5, such as shown, for example, in U.S. Pat. No. 5,040,777, which is incorporated herein by reference. The copier/printer 5 includes housing 7 that incorporates the machine's xerographic section 8 and a copy sheet supply section behind doors 14 and 15. Copy sheet output stacking device or tray 20 is molded into and is a part of the front doors which allow access to the copy sheet supply section when the roll or cut sheet paper supply is exhausted.

Copy sheet output device 20 is adapted to gather the output copies from the machine as they exit the front of the machine and stack them in the same order as the sequence of originals or as the images are presented by a printer. The copies within the stack can be random in size, ranging from "A" to "E" size, and composed of any media. The stacker creates no obstruction to access to the media supply in a roll feed cutter assembly (not shown) which is positioned in the bottom of the machine. As shown in FIG. 1, the front of machine housing 7 has doors 14 and 15 that are opened to provide access to the machine's paper supply. Copy sheet output stacker 20 is preferably made of plastic and molded into the doors as an integral member, but could be attached to the doors by use of any conventional attachment means, such as, screws, rivets, glue, clamps, etc. Stacker 20 comprises upper portions 21 and 22 that are configured as one halves of a wedge, i.e., a first portion thereof extends downward and away from the door panels at an acute angle with respect to the vertical door panels and terminates at a second portion thereof that is parallel to the door panels and which in turn terminates when it reaches a third portion thereof that is orthogonal to the door panels. Copy sheet lead in baffles 23 and 24 are spaced from the upper portions 21 and 22 and molded at the bottoms thereof to the bottom of the door panels. The baffles include an upper portion thereof that is curved away from the panel doors in order to facilitate stacking of all size sheets. A hinged stop plate 30 is provided in order to allow the stacker to accommodate the stacking of copy sheets up to 24".

Figure 2A:
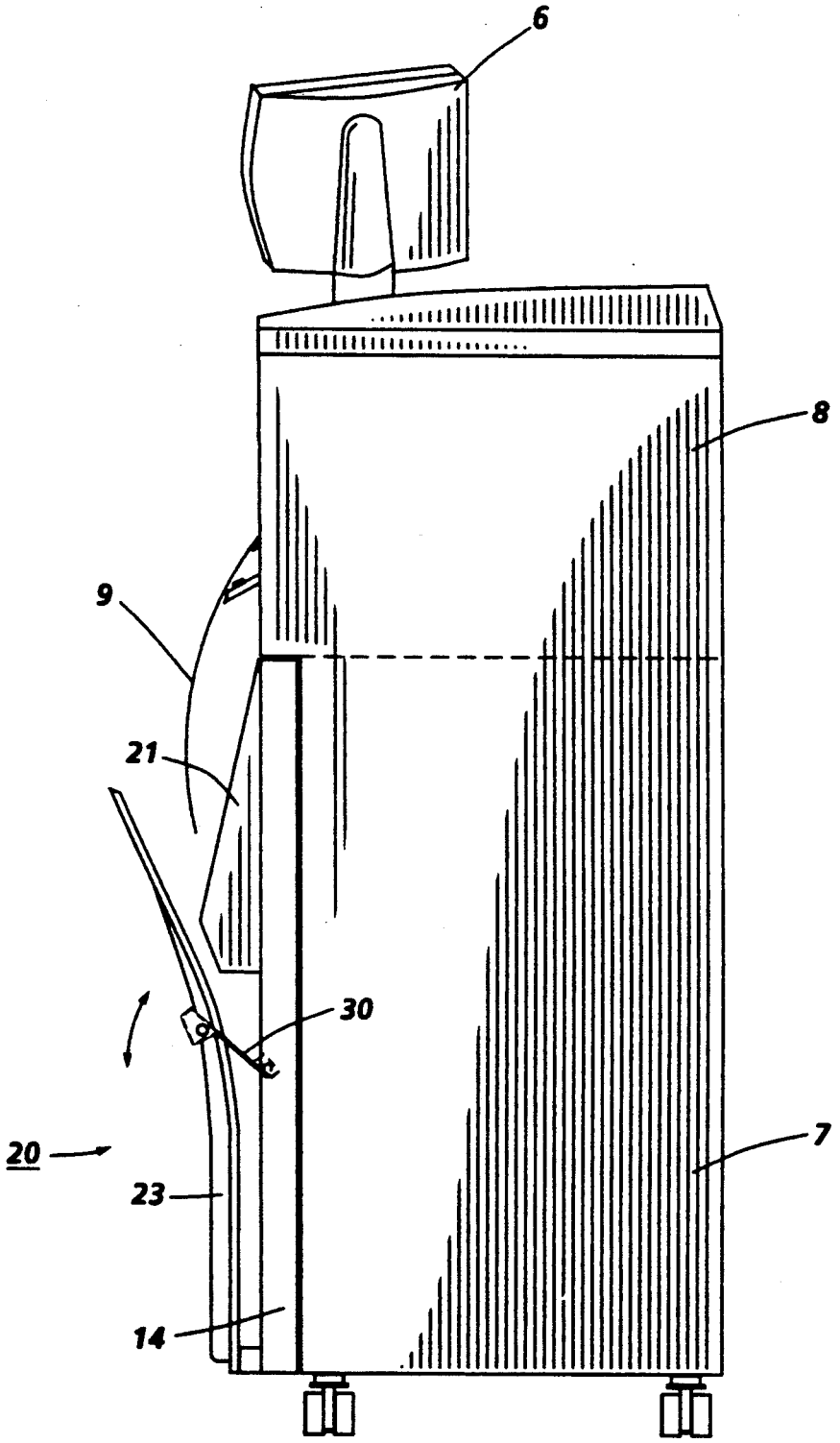
FIGS. 2A–2D are partial schematic side views of the copier/printer of FIG. 1 showing the operation of the copy sheet output stacker.
Figure 2B:
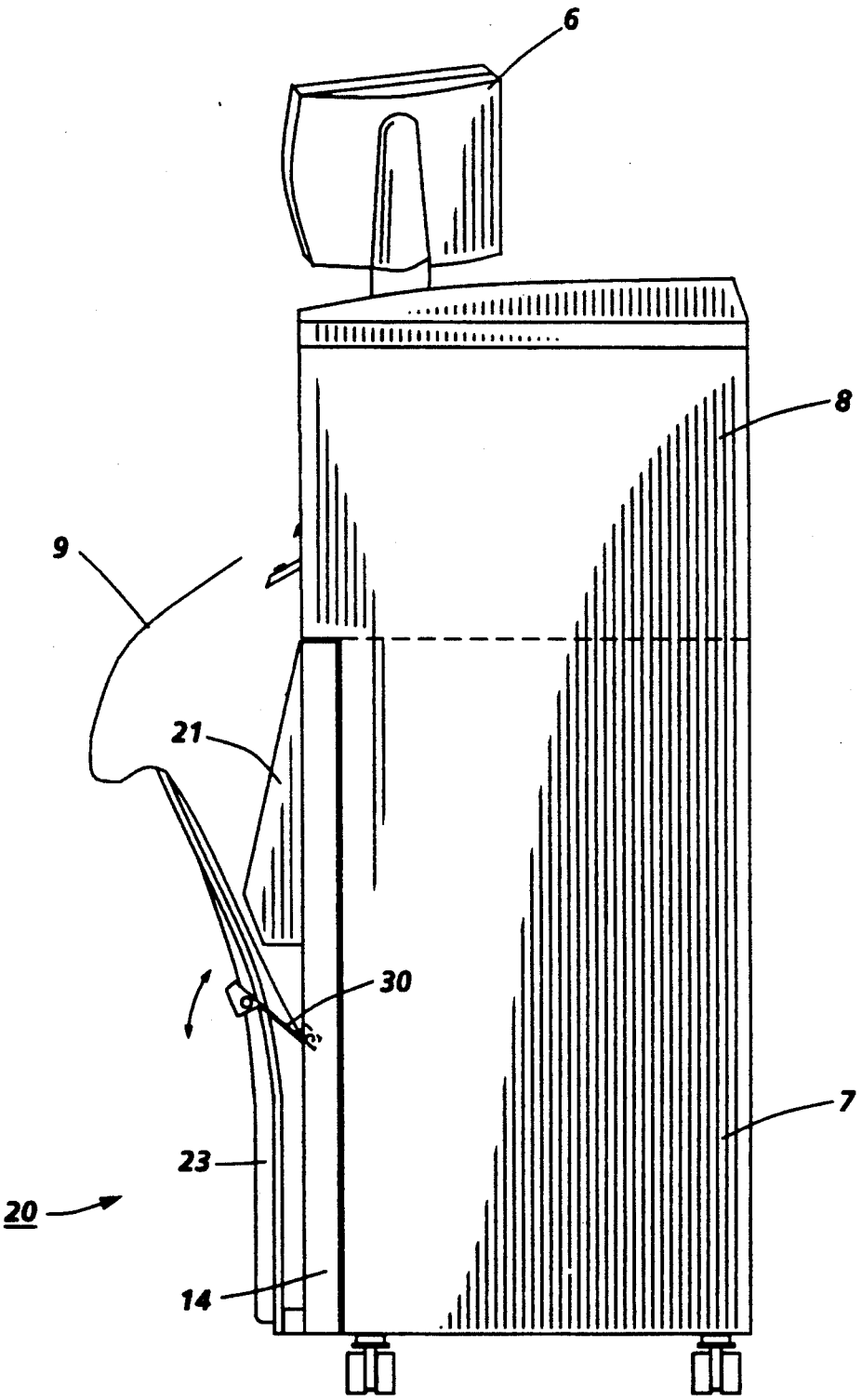
Figure 2C:
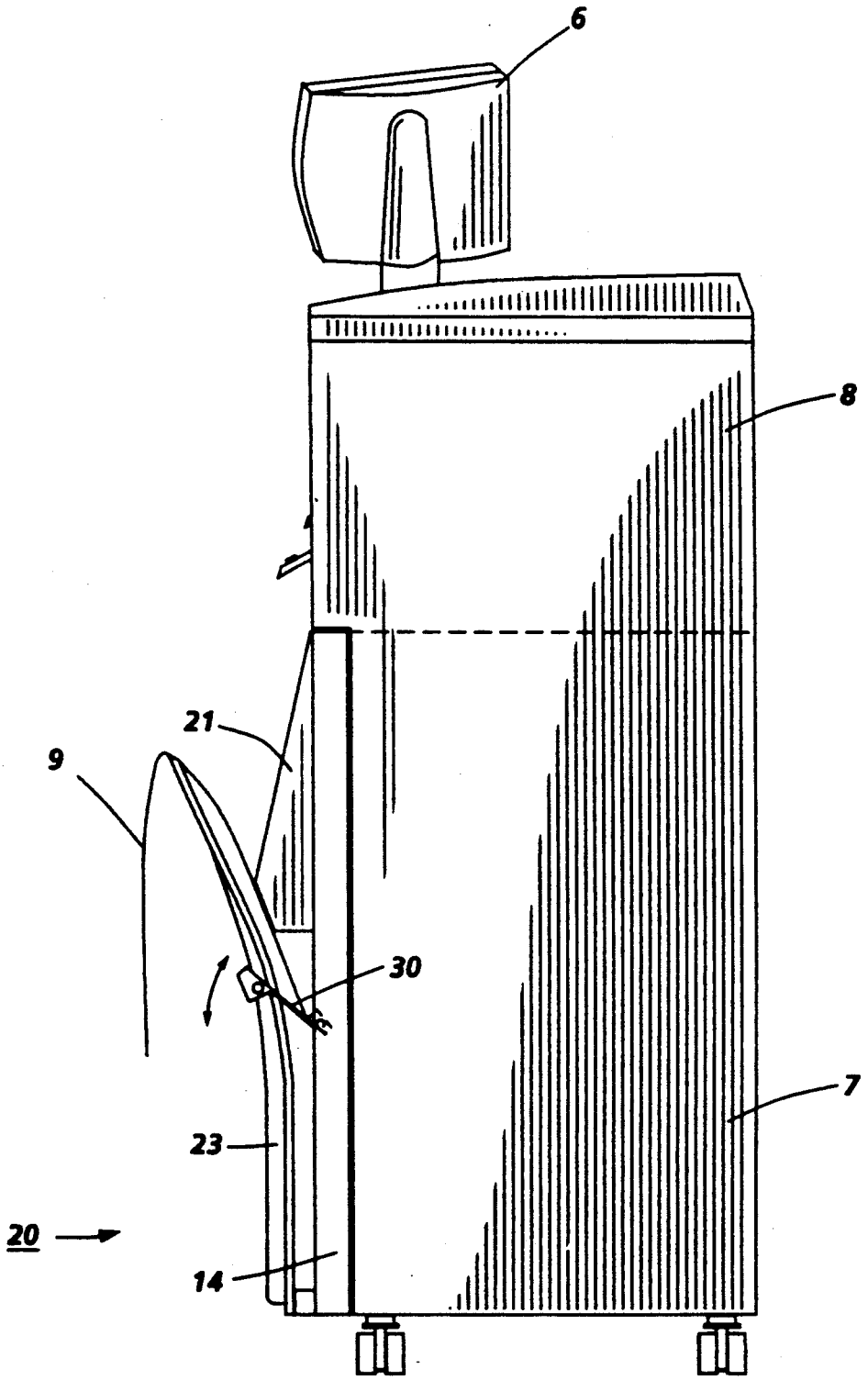
Figure 2D:
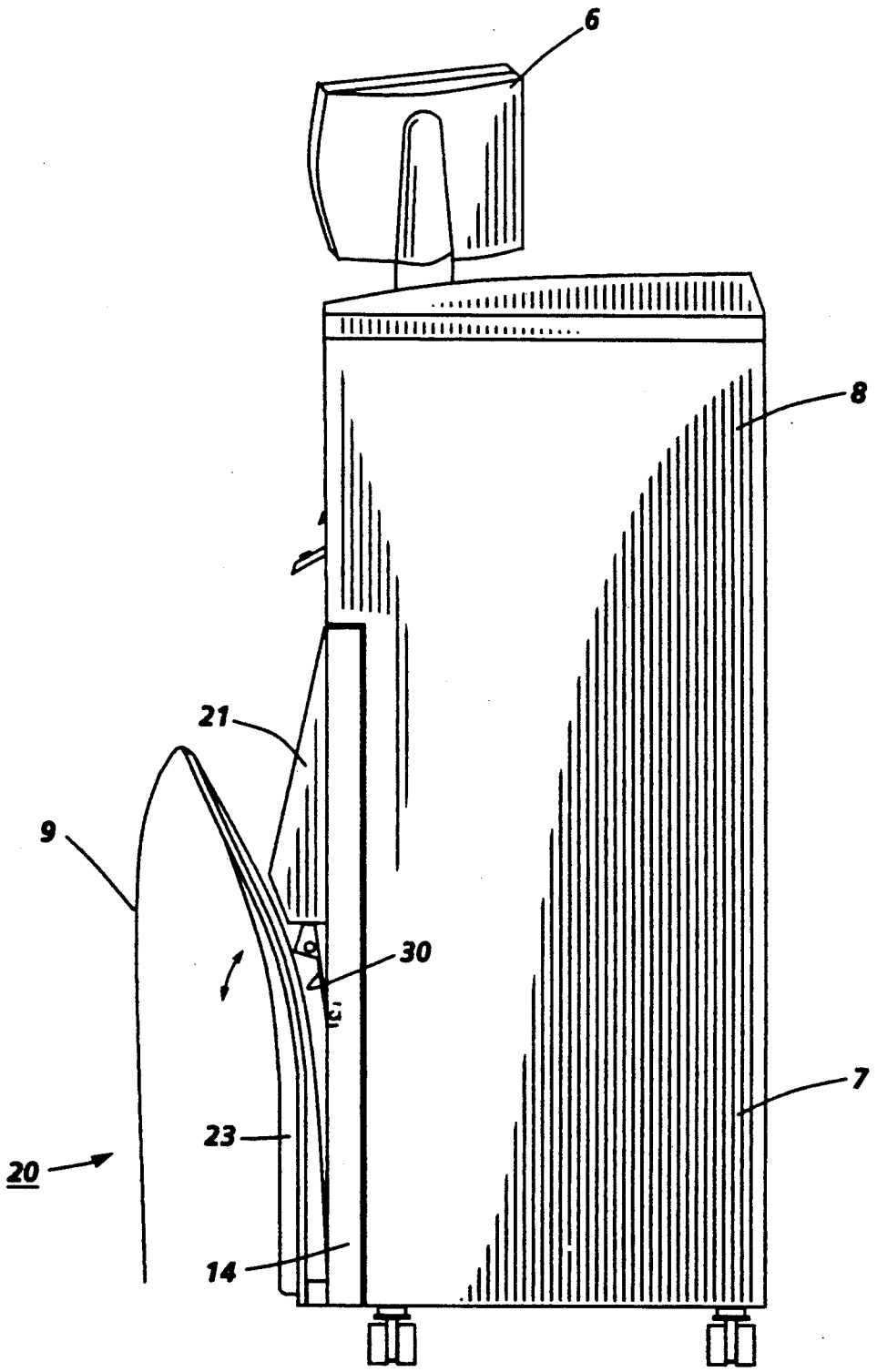

The operation of copy output stacker 20 will be described with reference to FIGS. 2A–2D where as an output copy sheet 9 is fed out of the front of machine 5, the lead edge of the copy sheet is driven downward in FIG. 2A by gravity and proceeds on a path bounded by the front face of the media doors and the stacking tray. The lead edge proceeds downward until it reaches one or both of the two stops 30 in FIG. 2B. When this occurs, the lead edge stops, but the trail edge continues to be fed out of the machine, forcing the body of copy sheet 9 over the top edge of the stacking tray 20 as shown in FIG. 2C. As the trail edge of the copy sheet clears the machine, it flips over the top edge of guide plates 23 and 24 and hangs, image side down, over the guide plates. The hinged stop plates 30 are set prior to the copy run according to the length of copies desired. The hinged stop plates are opened when copies of less than 24" in length are programmed on console 6, and they are closed flush with the doors, as in FIG. 2D, when running copies greater than 24" and up to 48" in length. It should be understood that the copy sheet output stacker 20 can also be used, when attached to the rear of copier/printer 5, as a stacker for original documents exiting the rear of the copier/printer as well.

Several advantages are obtained with use of the copy sheet output stacker 20 including its low cost through the use of one set of stacking trays with two stops to accommodate various lengths of copy sheets as opposed to two separate trays.

It should be understood that a low cost copy sheet output stacker has been shown and described that includes a vertical catch tray attached to the front panels of copier/printer for accepting the lead edge of copy sheets and allowing the copy sheets to bend over the top of the catch tray in a stacked position under gravity.

A manually operated hinged stop is adapted to be positioned in a "down" position for paper sizes 11" to 24" and in an "up" position for paper sizes 24" to 48".

This invention has been described in detail with particular reference to a preferred embodiment thereof, but it will be understood that variations and modifications can be effected within the spirit and scope of the invention and all such variations and modifications are intended to be covered by the appended claims.

What is claimed is:

1. A copy output stacking tray for a wide format machine which includes an upstanding front portion with a pair of vertically positioned door panels therein that are openable for the replenishment of copy sheet supplies and having top and bottom portions, comprising:

a first portion of the stacking tray being attached to the top portion of each of the panel doors and including a portion extending down and away from the top of the door panels;

a second portion of the stacking tray being attached to the bottom portion of each of the door panels and extending coextensively with but spaced from the panel doors in order to form a pocket to catch copy sheets; and at least one hinged plate which when in a first position allows copy sheets to travel to the point where said second portion is attached to the door panels and when in a second position is pivoted into the path of the copy sheets and serves as a stop in order to facilitate the stacking of varied lengths of copy sheets.

2. The copy output stacking tray of claim 1, wherein said first and second portions of the stacking tray are integrally molded into the door panels.

3. The copy output stacking tray of claim 1, wherein said stacking tray is adapted to stack copy sheet sizes 8½×11" to 36×48".

4. A copier having an upstanding front portion with a pair of vertically positioned door panels therein that are openable for the replenishment of copy sheet supplies and having top and bottom portions, and including a catch tray for stacking copy sheet output from the copier, comprising:

a first portion of the stacking tray being attached to the top portion of each of the panel doors and including a portion extending down and away from the top of the door panels;

a second portion of the stacking tray being attached to the bottom portion of each of the door panels and extending coextensively with but spaced from the panel doors in order to form a pocket to catch copy sheets; and at least one hinged plate which when in a first position allows copy sheets to travel to the point where said second portion is attached to the door panels and when in a second position is pivoted into the path of the copy sheets and serves as a stop in order to facilitate the stacking of varied lengths of copy sheets.

5. The copy output stacking tray of claim 4, wherein said first and second portions of the stacking tray are integrally molded into the door panels.

6. The copy output stacking tray of claim 4, wherein said stacking tray is adapted to stack copy sheet sizes 8½×11" to 36×48".

7. A printer having an upstanding front portion with a pair of vertically positioned door panels therein that are openable for the replenishment of copy sheet supplies and having top and bottom portions, and including a copy output stacking tray for stacking copy sheet output from the printer, comprising:

a first portion of the stacking tray being attached to the top portion of each of the panel doors and including a portion extending down and away from the top of the door panels;

a second portion of the stacking tray being attached to the bottom portion of each of the door panels and extending coextensively with but spaced from the panel doors in order to form a pocket to catch copy sheets; and at least one hinged plate which when in a first position allows copy sheets to travel to the point where said second portion is attached to the door panels and when in a second position is pivoted into the path of the copy sheets and serves as a stop in order to facilitate the stacking of varied lengths of copy sheets.

8. The copy output stacking tray of claim 7, wherein said first and second portions of the stacking tray are integrally molded into the door panels.

9. The copy output stacking tray of claim 7, wherein said stacking tray is adapted to stack copy sheet sizes 8½×11" to 36×48".

* * * * *